US005318185A

United States Patent [19]

Miller et al.

[11] Patent Number: 5,318,185

[45] Date of Patent: Jun. 7, 1994

[54] SURFACE CHEMISTRY CONTROL FOR SELECTIVE FOSSIL RESIN FLOTATION

[76] Inventors: Jan D. Miller, 1886 Atkin Ave., Salt Lake City, Utah 84106; Ye Yi, 2875 E. Wander Way, Salt Lake City, Utah 84117; Qiang Yu, 224 University Village, Salt Lake City, Utah 84108

[21] Appl. No.: 914,844

[22] Filed: Jul. 15, 1992

[51] Int. Cl.[5] ..... B03D 1/008; B03D 1/02

[52] U.S. Cl. ..... 209/166; 252/61

[58] Field of Search ..... 209/166, 167; 252/61

[56] References Cited

U.S. PATENT DOCUMENTS

| | | | |
|---|---|---|---|
| 1,773,997 | 8/1930 | Green | 209/167 |
| 2,378,152 | 6/1945 | Nagelvoort | 209/167 |
| 2,506,301 | 5/1950 | Klepetko | 209/166 |
| 2,591,830 | 4/1952 | Kepetko | 209/166 |
| 4,377,473 | 3/1983 | Laros | 209/166 |
| 4,724,071 | 2/1988 | Miller | 209/167 |
| 4,904,373 | 2/1990 | Miller | 209/167 |

FOREIGN PATENT DOCUMENTS

| | | | |
|---|---|---|---|
| 716609 | 2/1980 | U.S.S.R. | 209/167 |

*Primary Examiner*—Thomas M. Lithgow

[57] ABSTRACT

A froth flotation method is disclosed for separating fine particles of fossil resin from by use of frothing reagents which include an aliphatic organic compound having a polar group and containing not more than four carbon atoms. Butanol is an effective frothing reagent in this method.

11 Claims, 11 Drawing Sheets

SURFACE CHEMISTRY CONTROL FOR SELECTIVE FOSSIL RESIN FLOTATION

This invention was made with Government support under Contract No. DE-AC22-90PC90178 awarded by the Department of Energy. The government has certain rights in the invention.

BACKGROUND OF THE INVENTION

1. Field:

This invention relates to a method for treating resinous coal, and more particularly to a method for separating fossil resin from coal by froth flotation.

2. State of the Art:

Certain bituminous coals of the Western United States are known to contain appreciable quantities of macroscopic fossil resin (resinite). Such resinous coals are found in the states of Arizona, Colorado, New Mexico, Utah, Washington, and Wyoming, etc. The Wasatch Plateau coal field in Utah has a particularly high content of fossil resin. It has been reported that some seams in this field average as much as 5% resin.

Fossil resins had been recovered intermittently from the Utah coal field since 1929 by gravity and/or flotation processes. The production, nevertheless, was on a very small scale and past separation technologies have limited the development of a viable fossil resin industry. Generally resin flotation concentrates must be refined by solvent extraction and evaporation of the solvent. Solvent-purified resins from the Utah coal field typically have a molecular weight of about 1000–1500, a melting point of about 170° C. and an iodine number of about 145. This product, at the present time, has a market value of $0.50–0.70/lb as a chemical commodity and can be used in the ink, adhesive, rubber, varnish, enamel, paint and coatings, and thermoplastics industries. However, the technology for the recovery and utilization of fossil resins from coal did not receive sufficient research attention during the past decades. Research carried out in this field was very limited when compared to the research effort made for other energy and mineral commodities. Such a situation was due to the rapid development of petrochemical technologies after World War II and the abundance of synthetic resins. Because of the lack of technology and the competition from synthetic resins, this valuable fossil resin resource from western coal has been wasted for many years, being burned together with coal for electric power generation. Based on coal production data from the Utah region, it is estimated that at least 150 million pounds per annum of fossil resin from the Wasatch Plateau coal field is being used as fuel for electric power generation.

During the past decades, there have been a few patents issued which describe the flotation separation of fossil resin from coal by froth flotation. They include U.S. Pat. No. 1,773,997 (by Green, 1930), U.S. Pat. No. 1,869,532 (by Weining, 1932), U.S. Pat. No. 2,506,301 (by Klepetko, 1950), U.S. Pat. No. 2,591,830 (by Klepetko, 1952), U.S. Pat. No. 4,377,473 (by Laros and Pick, 1983), U.S. Pat. No. 4,724,071 (by Miller and Ye, 1988), U.S. Pat. No. 4,904,373 (by Miller, et al., 1990), as well as the USSR Patent 716,609 (1980). In all of these inventions, fossil resin particles are removed by attachment to dispersed air bubbles and the fossil resin particle/bubble aggregates float to the top of the flotation cell to form a froth product while coal and other gangue particles generally remain in suspension. In this way, fossil resin is separated from coal. The extent of the fossil resin separation from coal and the sophistication of the technology basically have progressed, from conventional flotation technology, to selective oxidation and selective dispersion. However, both fossil resin and coal exhibit a natural hydrophobicity and such separation is not easy.

Most work in the field of resin-coal separation by froth flotation techniques has realized higher alcohols (Laros; 6 to 8 carbon atoms alcohols), the use of amyl alcohol, a five carton alcohol, is disclosed in Green as a suitable frothing agent. Green used amyl alcohol as the sole frothing agent and indicated generally the use of higher alcohols, turpentine, cresol, pine oils and the like.

Recent important patents in this field are U.S. Pat. Nos. 4,724,071 and 4,904,373 issued in 1988 and 1990, to Miller, et al., respectively. U.S. Pat. No. 4,724,071 teaches the use of ozone to selectively oxidize the surfaces of finely-ground coal particles to achieve selective flotation separation of fossil resin from coal. This technology was invented based on the discovery that the native difference in hydrophobicity between the fossil resin and coal as measured by contact angle and bubble attachment time is small. Because of this fact, some of the coal particles in suspension always attach to air bubbles during the flotation of fossil resin, causing a poor separation efficiency. By selective oxidation with ozone, coal particles become extremely hydrophilic and will not attach to air bubbles during flotation while the natural hydrophobicity of fossil resin can be retained by proper control of ozone dosage and oxidation time. In this way, excellent flotation separations can be achieved with a flotation product containing as much as 95% resin at a recovery of 70–80%. However, environmental concerns, health/safety issues and cost associated with grinding have limited the adoption of this technology by the coal industry.

U.S. Pat. No. 4,904,373 teaches the importance of raising the suspension pH into the alkaline region so that the natural resin/coal particle aggregates in suspension can be effectively dispersed and the selective flotation of fossil resin can be achieved. This innovation was based on the discovery that fine coal particles tend to aggregate at the surfaces of fossil resin particles. Under these circumstances, the selective flotation of fossil resin from coal can be improved by any method which can effectively disperse the resin/coal particle aggregates and still maintain a suitable difference in hydrophobicity between the resin and coal particles. Although this pH control procedure results in a lower grade fossil concentrate than that given by selective ozone oxidation, it is expected to be most useful for industry in view of its simplicity, effectiveness and economy.

Nevertheless, the pH control technology, U.S. Pat. No. 4,904,373, which teaches how to achieve suitable dispersion for flotation of fossil resin from coal, is only one of the necessary conditions for selective flotation. In order to achieve selective flotation, another condition must be satisfied, namely the control of particle hydrophobicity. With conventional prior art reagents (frothers) some of the coal particles in the suspension are hydrophobic and tend to float together with resin particles. In this regard, necessary control has to be taken to minimize the flotation of coal particles in order to achieve the desired resin grade in the froth concentrate.

In view of the fact that a viable fossil resin industry has yet to be established, it is clear that improved separation technologies are needed for the more efficient recovery and separation of fossil resin from coal.

SUMMARY OF THE INVENTION

In this invention, it has been discovered that shorter chain surfactants, including alcohols, amines and carboxylic acids, with than 6 carbon atoms are better than prior art reagents (frothers) for the flotation separation of fossil resin from coal. In addition, the instant invention teaches the use of a blend of these short chain frothers, particularly a blend of a five carbon reagent with other reagent(s) having less than five carbon atoms, in order to achieve improved fossil resin flotation from coal. The actual blending ratio between 5 carbon reagent and the reagent having less than 5 carbon atoms will depend on the coal characteristics. In some cases, the process will require 100% of reagent containing less than 5 carbon atoms.

The process includes forming a slurry consisting of water, coal particles, and fossil resin particles. After achieving successful dispersion by pH control as taught in U.S. Pat. No. 4,904,373 or any other method which accomplishes the same objective, a blend of these short chain reagents is then added into the flotation machine to accomplish the selective flotation of fossil resin from coal. Effective pH control in the instant invention can be achieved at pH 9.5 and above and especially at pH 10.5 and above. The froth concentrate produced will be concentrated fossil resin particles while the coal particles remain in suspension. In this way, an improved selective flotation of fossil resin from coal can be accomplished at a pH of 9.5~10.5. This invention can also be utilized to achieve selective flotation of different resin types as will be evident from examples given later.

DETAILED DESCRIPTION OF THE PREFERRED EMBODIMENT

Initially, the resin and coal particles must be of a floatable size by any suitable means such as that taught and utilized in the art of mineral processing and/or coal preparation. Typically, the particles should be minus 28 mesh. However, minus 10 mesh material can even be accommodated in some instances. The term "mesh" as used here refers to Tyler mesh. After obtaining particles of the desired size, a slurry consisting of water, coal particles and resin particles is formed. Next, the slurry is dispersed by pH control as taught in U.S. Pat. No. 4,904,373 or by any other method which accomplishes the same objective, and the surface chemistry of the system is then controlled by proper reagent(s) addition. It should be noted that, in some cases, satisfactory flotation separation of resin from coal can be achieved even at a pH value of about pH 9.5 for the current invention, the actual pH value will depend on the coal type. Finally, the suspension is ready for flotation and under these circumstances, improved flotation of fossil resin from coal can be achieved.

Figure 1:
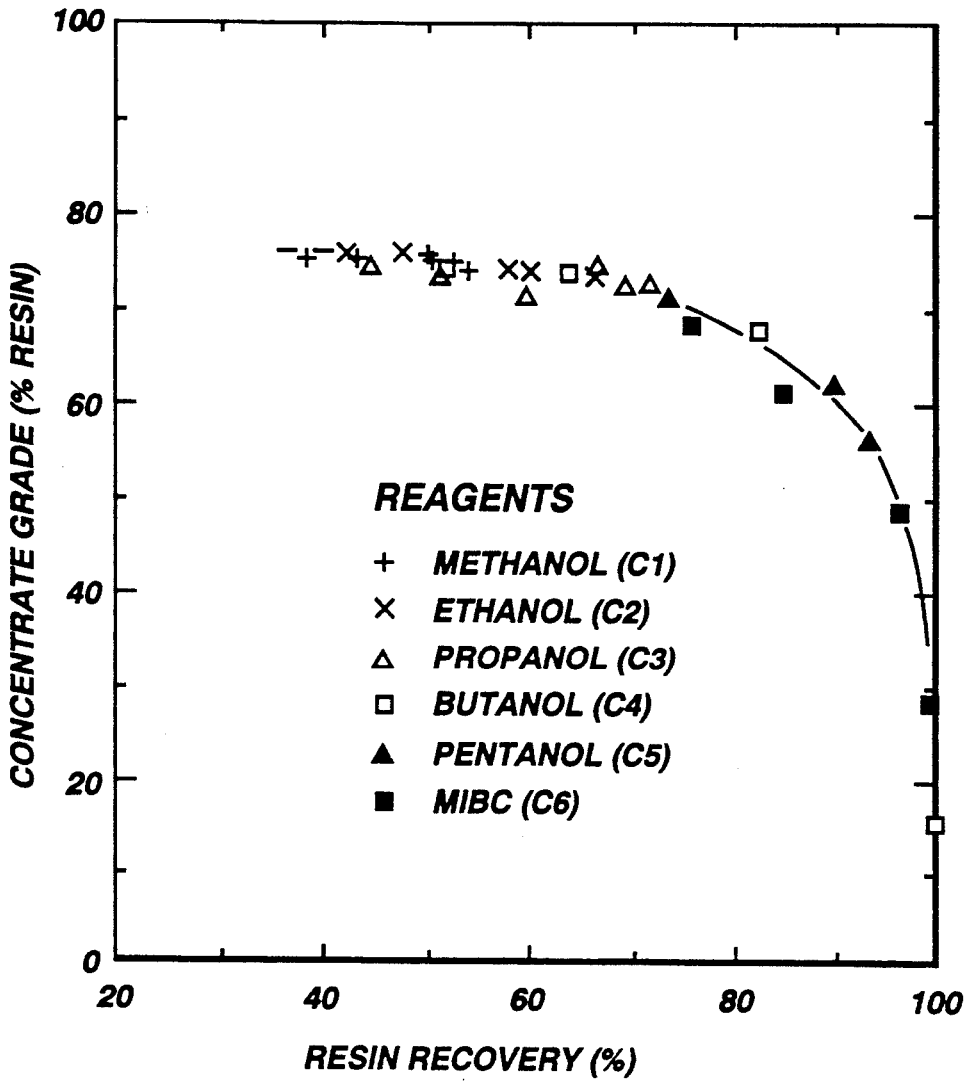
FIG. 1 is a graph depicting resin content in the concentrate product versus resin recovery for different frothing reagents.

Experiments were conducted with different reagents (alcohol frothers) having a different number of carbon atoms. The flotation was done with a 2 liter Denver flotation cell at 15% solids concentration, 900 rpm and an air flowrate of 3.5 liters per minute. The flotation time was 5 minutes. Particle size was minus 100 mesh and the feed was found to contain about 5% resin. The results are given in FIGS. 1 and 2. FIG. 1 appears to show that there is no difference with respect to the type of frothing reagent used for the selective flotation of fossil resin from coal. The data presented in FIG. 2, in which the effect of reagent addition on concentrate grade is given, indicates a significant observable difference. As understood from the flotation art and as demonstrated in FIG. 2, frothing reagents such as MIBC (6 carbon atoms) have an indiscriminate action, causing coal particles to float and decreasing the resin grade in the flotation concentrate. On the other hand, frothing reagents having 5 carbon atoms or less are more discriminate and thus achieve improved flotation separation from coal.

Figure 2:
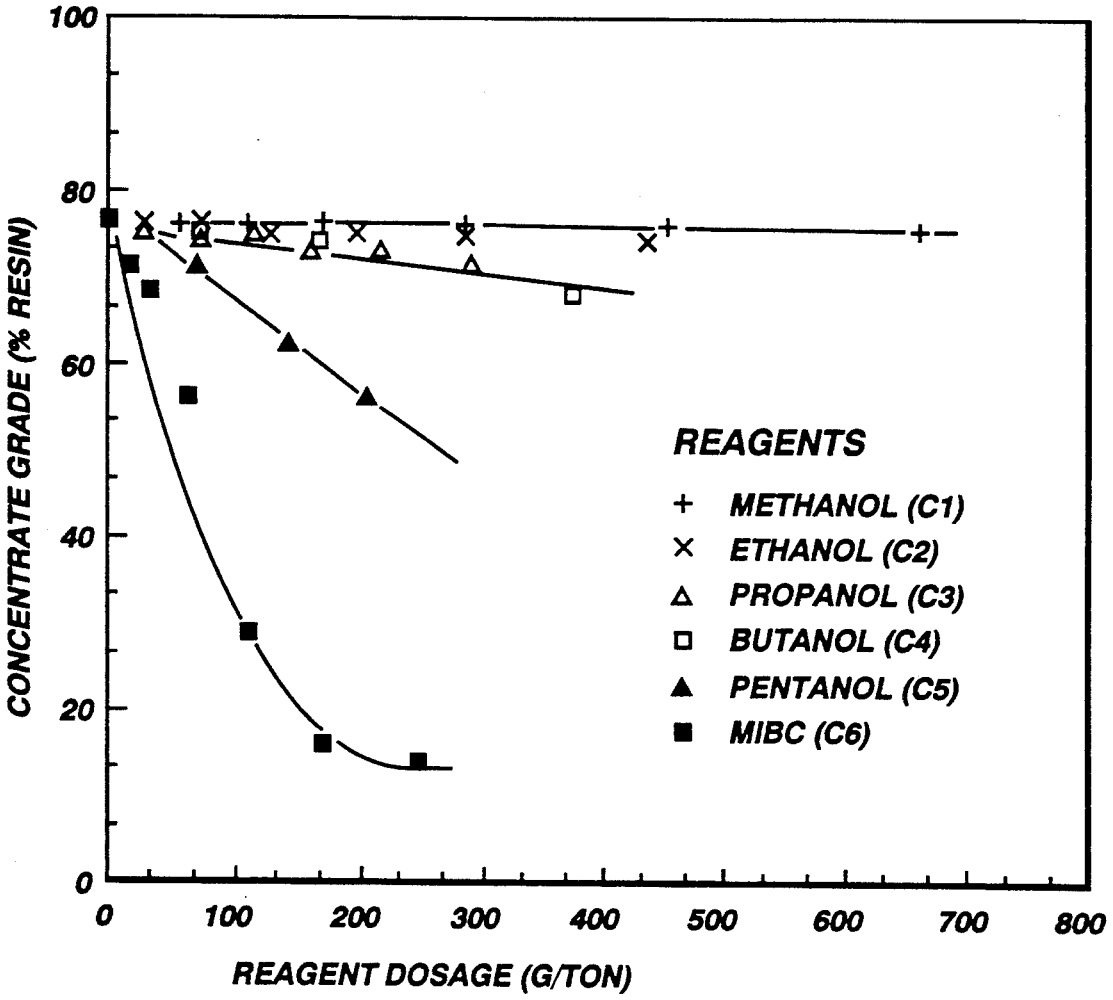
FIG. 2 is a graph depicting resin content in the concentrate product as a function reagent dosage for different frothing reagents.

The laboratory results presented in FIG. 2 also suggest that the best frothing reagents which should be used to achieve a high quality resin concentrate are those which have less than 5 carbon atoms (say, for example, 3 or 4). However, this suggestion actually may not be the case in actual flotation practice. As can be understood from the flotation art, it is well known that a satisfactory froth phase has to be formed so that it is able to hold the hydrophobic particles for their eventual removal from the flotation machine. In this view, a trade-off is expected between the carbon chain length for the best concentrate grade and the carbon chain length suitable for good froth stability. To determine the optimal carbon chain length for the selective flotation separation of fossil resin from coal, another series of tests which emphasized froth stability were conducted. In this work, 100 ml of water containing different reagents at different concentrations and 5 grams of resin particles with a particle size of 100×200 mesh were placed into a glass tube, one inch in diameter and with a ceramic filter at the bottom. Nitrogen gas at a flowrate of 0.75 liter per minute was introduced into the tube through the ceramic filter. When the rising froth reached steady state, the height of the froth was measured. Basically, the greater the froth height, the easier to collect and remove the fossil resin in the froth phase. The experimental results are given in FIG. 3, plotted as froth layer height (cm) versus reagent concentration in the aqueous phase.

Figure 3:
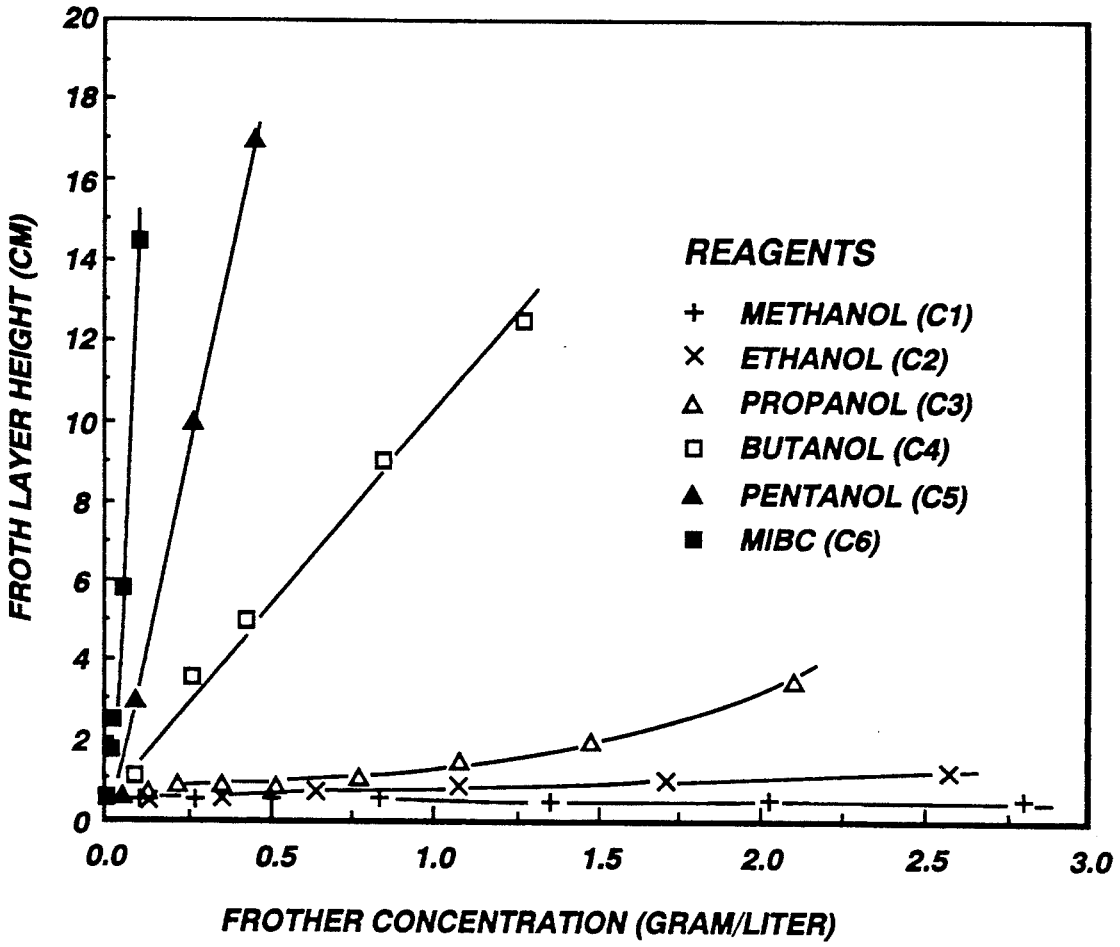
FIG. 3 is a graph depicting froth layer height as a function of reagent concentration for various frothing reagents.

As clearly demonstrated in FIG. 3, the longer the carbon chain length (represented by the number of carbon atoms in the chain), the greater is the froth height formed and the easier it would be to collect and remove fossil resin in the froth phase. Further, the current invention illustrates that the optimal number of carbon atoms in a frothing reagent to be used is a function of coal surface properties (or surface chemistry characteristics). When these surface properties change, the blending ratio between 5 carbon reagent and the reagents having less than five carbon has to be changed. In some cases, frothers will have to be blended with reagents all of which contain less than 5 carbon atoms, as will be illustrated in the following examples. By consideration of both factors, hydrophobicity and froth stability, it is clear that a frothing reagent having less than 6 carbon atoms should be used for the selective flotation of fossil resin from coal. Further, results from FIGS. 1 to 3 teach that a mixture of these short chain alcohols provides especially good flotation separation. Such a mixture should consist of a frothing reagent having 5 carbon atoms, giving good froth stability, with another frothing reagent having less than 5 carbon atoms. In this way, the frothing reagent having less than 5 carbon atoms can provide for discrimination between resin and coal particles and facilitate the bubble/resin particle attachment for flotation.

Further, the current invention illustrates that the optimal number of carbon atoms in a frothing reagent to be used is a function of coal surface properties (or surface chemistry characteristics). When these surface properties change, the blending ration between the 5 carbon reagent and the reagents having less than five carbon has to be changed. In some cases, frothers will have to be blended with reagents all of which contain less than 5 carbon atoms, as will be illustrated in the following examples.

EXAMPLE 1

Figure 4:
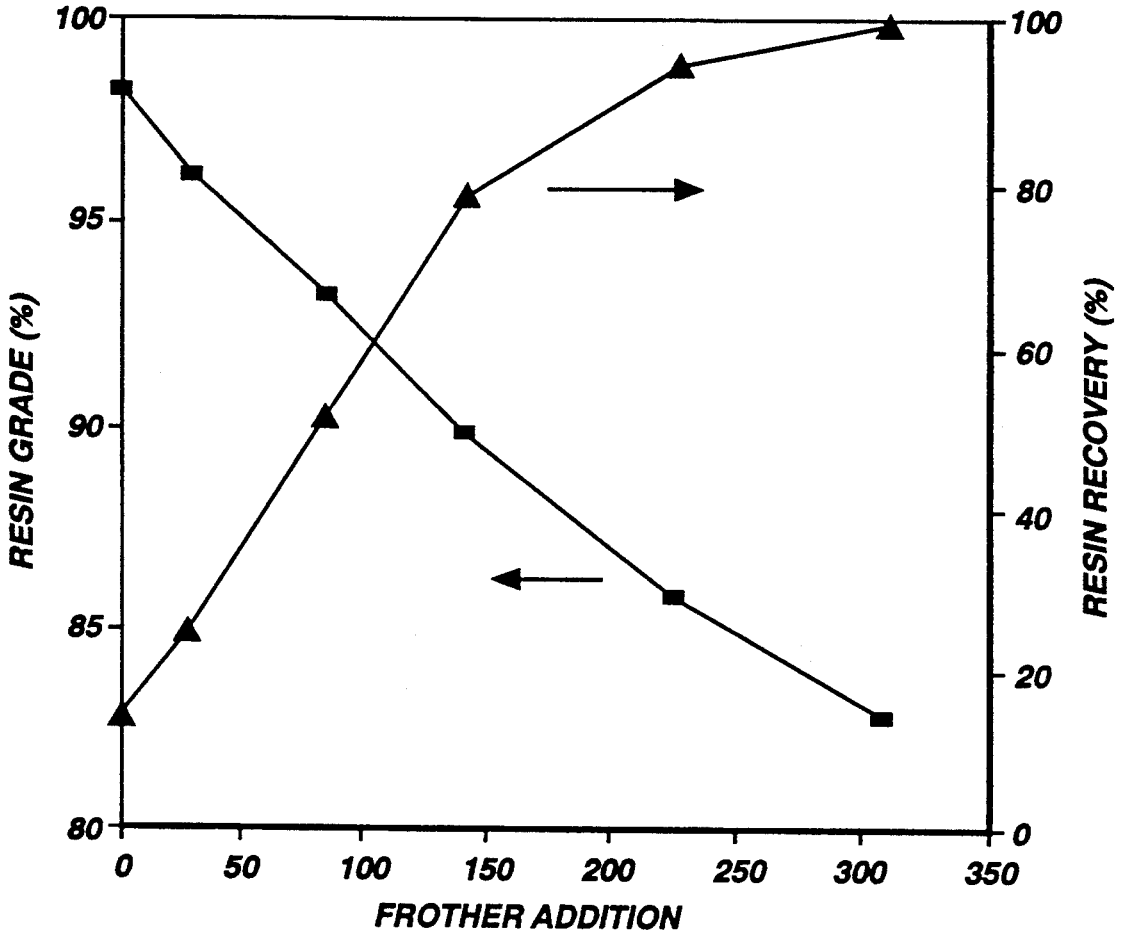
FIG. 4 is a graph depicting resin grade and resin recovery as a function of frothing reagent addition wherein the frothing agent is a 1:1 ratio of pentanol to butanol by weight (high resin content feed).

FIG. 4 gives an example as taught by the spirit of the current invention. In this work, a flotation concentrate produced by conventional technology was placed in a 2 liter Denver flotation cell for the selective flotation of fossil resin with a blend of short chain reagents. The minus 28 mesh feed (concentrated from conventional flotation) contains about 40% fossil resin and 60% coal. The suspension was first conditioned at 1500 rpm for 3 minutes. Next, a frothing reagent containing 1:1 ratio of pentanol ($C_5$) to butanol ($C_4$) (by weight) was added into the flotation cell at the desired level of addition and the resin flotation was carried out at 1200 rpm and 4 liter per minute air flowrate. Products thus produced were collected and analyzed.

As clearly shown in FIG. 4, flotation with this blend of 5 carbon and 4 carbon alcohols provides a flotation concentrate containing about 90% fossil resin at a recovery of almost 80%. Alternatively, a flotation concentrate containing about 83% resin can be obtained at a recovery of almost 100%, depending On the reagent addition used.

EXAMPLE 2

Figure 5:
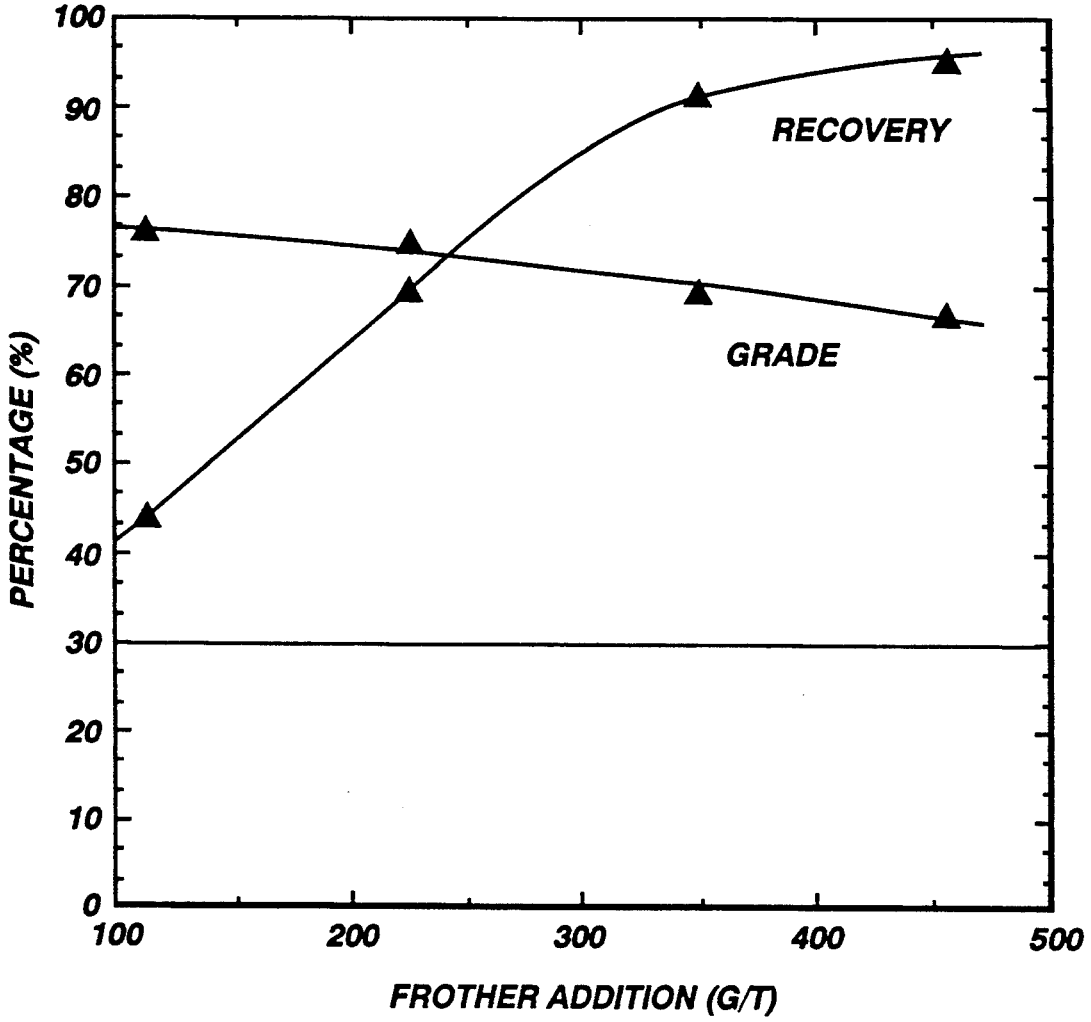
FIG. 5 is a graph depicting resin grade and recovery as a function of frothing reagent addition wherein the frothing reagent is a 1:1 ratio of pentanol to butanol by weight (low resin, content feed).

FIG. 5 gives another example as taught by the spirit of the current invention. In this work, a lower grade feed sample containing 7% fossil resin was used (also minus 28 mesh). The flotation was conducted with a 2 liter Denver flotation cell at 15% solids concentration, 4–5 liter per minute air flowrate, and 900 rpm. About 4 kg/ton of $Ca(OH)_2$ was also added into the flotation cell prior to the addition of frothing reagent, as taught by U.S. Pat. No. 4,904,373, for dispersion purpose. Next, a frothing reagent containing 1:1 ratio of pentanol ($C_5$) to butanol ($C_4$) (by weight) was added into the flotation cell at the desired level of addition and the resin flotation was carried out for 5 minutes. Products thus produced were collected and analyzed.

As clearly shown in the figure, even with a low grade feed material, flotation with this blend of 5 carbon and 4 carbon alcohols provides a flotation concentrate containing about 70% fossil resin at above 90% recovery when the reagent addition is greater than 0.35 kg/ton.

The reason for using a frothing reagent having less than 6 carbon atoms or, in particular, for using a blend of reagents comprising one reagent of 5 carbon atoms and other reagents having less than 5 carbon atoms can be further supported by examination of critical surface tension of wetting data. In this immersion test, 0.5 grams of coal or fossil resin particles having a size of 28×60 mesh was gently placed on the surface of a water/methanol solution with a known surface tension. The volumetric ratio between the water and the methanol was adjusted to obtain different surface tension values. Particles having a surface tension of wetting greater than the solution surface tension gradually sunk to the bottom of the solution, while particles with a surface tension of wetting smaller than the solution surface tension remained suspended at the surface. After 12 hours, particles which remained at the surface were carefully collected, dried and weighed. These particles basically represented the "hydrophobic" portion of the sample for the specified surface tension of the solution.

Figure 6:
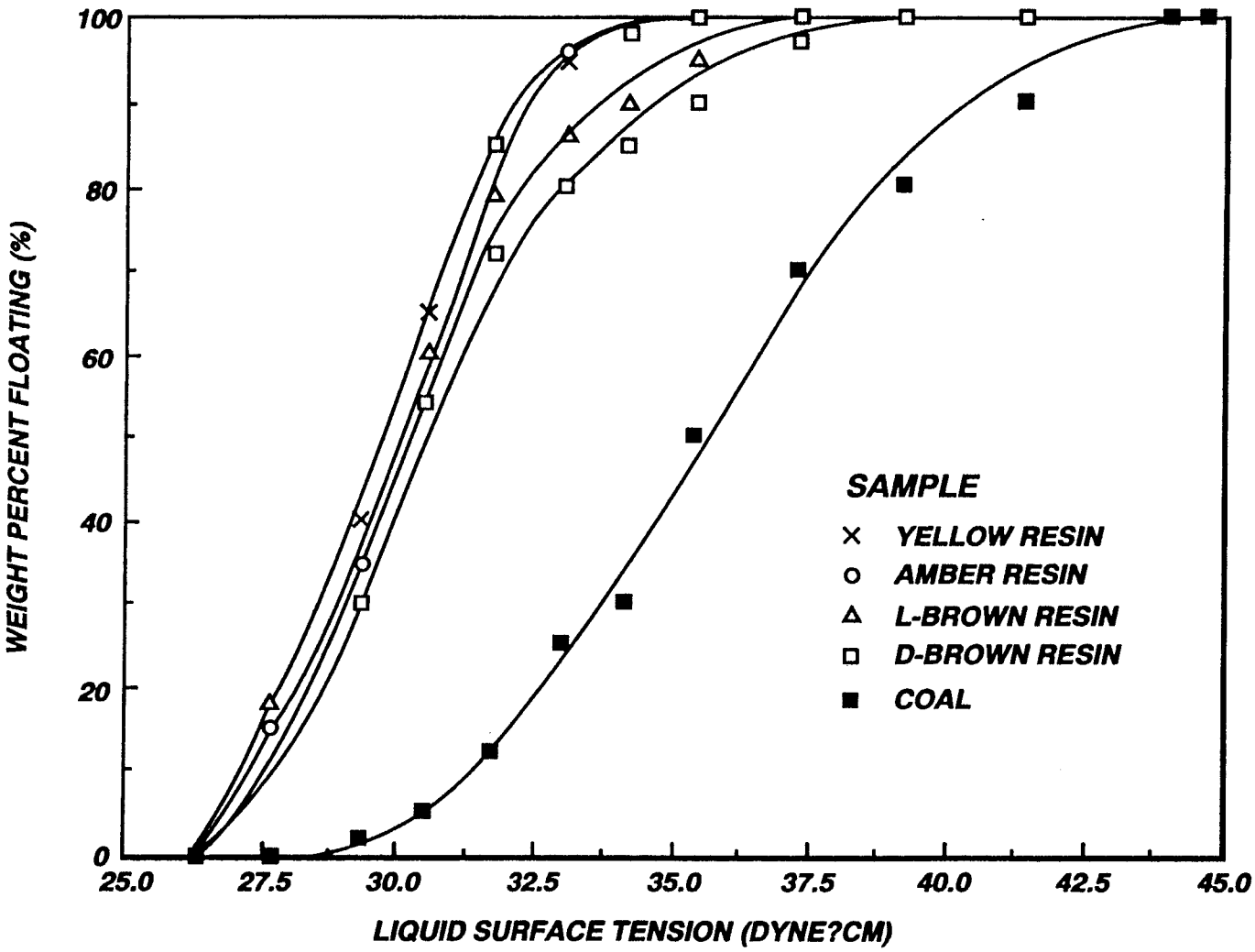
FIG. 6 is a graph depicting the quantity of resin floated as a function of solution surface tension for different resin types.

The experimental results, given in FIG. 6, are plotted as weight percent floating versus the solution surface tension for different fossil resin particles and coal particles. Note that the fossil resins from Utah coal can be sorted into four color types: yellow, amber, light-brown, and dark-brown (Q. Yu et al., "Characterization of Resin Types from the Hiawatha Seam of the Wasatch Plateau Coal Field," *Fuel Processing Technology*, vol. 28, 1991, pp. 105–118). More detailed discussion will be given later. From FIG. 6, the mean critical surface tensions of wetting for the resin types and the coal are determined as 30 and 36 dyne/cm, respectively (the mean critical surface tension is the surface tension at which 50% of particles remain hydrophobic or, simply remain floating at the surface). FIG. 6 reveals several important features. First, it shows that the fossil resin is slightly more hydrophobic than coal, as evidenced by a smaller mean critical surface tension of wetting. Second, because the difference in hydrophobicity as measured by the difference in critical surface tension between resin and coal is very small, a poor flotation separation of fossil resin from coal by froth flotation is expected if the reagent (frother) and the associated reagent schedule are the typical frothers (for example, $C_6$ or higher carbon frothers) used in coal flotation practice. Third, and most important, with the proper selection of reagents (frothers) as well as the level of reagent addition, the surface tension of the system can be adjusted such that a satisfactory flotation separation of fossil resin can be achieved. Long chain alcohol frothers actually adsorb at coal surfaces through hydrogen bonding with surface functional groups. Such adsorption can decrease the difference between the critical surface tensions for fossil resin and coal, causing coal particles to float and lowering fossil resin grade in the flotation concentrate product. In this way, the data given in FIG. 6 help to demonstrate again that the use of frothers having 6–8 carbon atoms as taught in U.S. Pat. No. 4,377,473 actually leads away from selective flotation of fossil resin from coal as taught by this instant invention.

In principle, it might be possible to control surface tension with frothing reagents having 6 carbons or more. But in practice, such control is extremely difficult and becomes almost impossible in plant application in which all the operation conditions such as solids concentration, feed grade, feed material surface chemistry features, particle size distribution, slurry pH, residual reagent concentration, etc. fluctuate from time to time. On the other hand, the use of frothing reagent with less than 6 carbon atoms facilitates the control of the system and allows for a significant improvement in the selective flotation of fossil resin from coal.

EXAMPLE 3

Figure 7A:
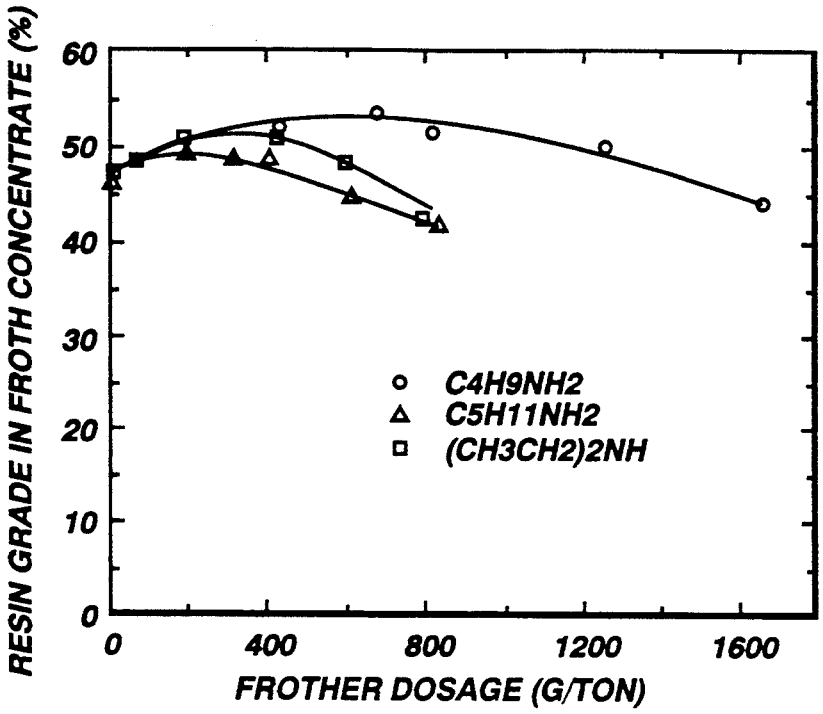
FIGS. 7(*a*) and 7(*b*) are graphs depicting resin grade and resin recovery, respectively, as a function of frother dosage for several lower aliphatic amine frothers (very low resin content is feed).
Figure 7B:
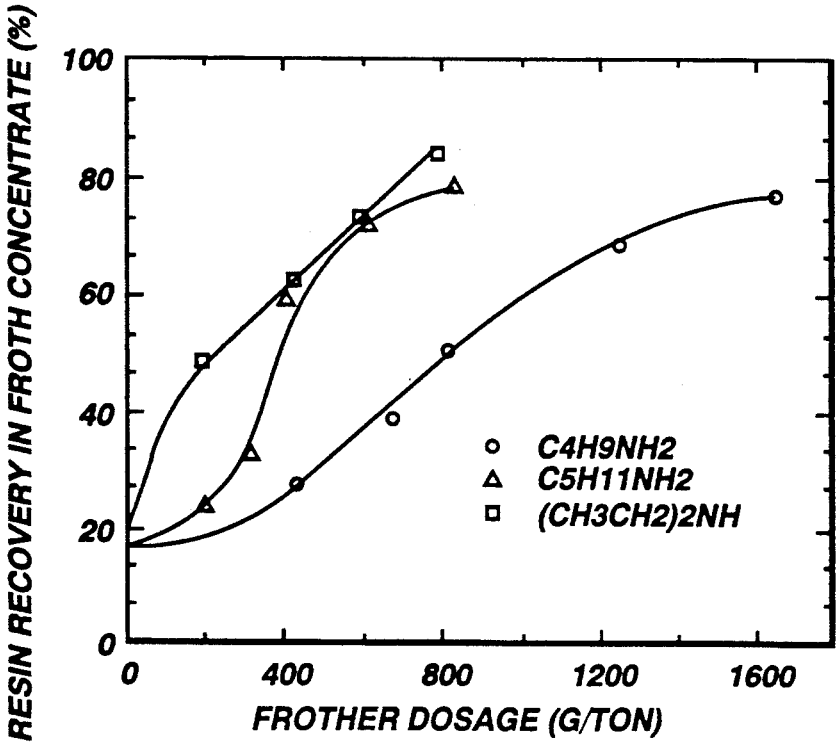

As another example, FIG. 7 provides some experimental results obtained with amines as reagents for the flotation of fossil resin from coal. The flotation procedures in this work were similar to that given in Example 2 except that the feed material contains much lower fossil resin (about 4%) and is more difficult for selective resin flotation due to slimes present in the system. Thus, the flotation in this case results in the concentrate products containing less fossil resin when compared to Example 2. The intent of the invention is, however, clearly shown.

EXAMPLE 4

As mentioned previously, four types of fossil resin from the Wasatch Plateau coal field have been identified. They are classified by color as yellow, amber, light brown, and dark brown. The change in the color of fossil resin represents a change in its physical and chemical properties. It is known from the literature that light colored fossil resin has a much higher market value than dark colored resin. The former can be used in premium colored inks while the latter is mostly used in black inks. In this way, selective separation of these fossil resin types, at least into two different colors: light and dark, is of commercial importance. Experimental results further illustrate that these four types of fossil resin can be separated by the flotation procedure described in the instant invention. In this work, a fossil resin concentrate containing four types of fossil resins with a particle size of 28×60 mesh was placed in a 1 liter Denver flotation cell for the selective flotation of fossil resin types with a blend of short chain alcohols. The suspension was first conditioned at 1500 rpm for 3 minutes. Next, a frothing reagent containing 6:3:1 ratio of propanol ($C_3$):pentanol ($C_5$):butanol ($C_4$) (by weight) was added into the flotation cell at a level of 0.35 kg/ton, then resin flotation was carried out at 1200 rpm and 1.5 liter per minute air flowrate. Froth products thus produced were collected at different time intervals and analyzed.

Figure 8:
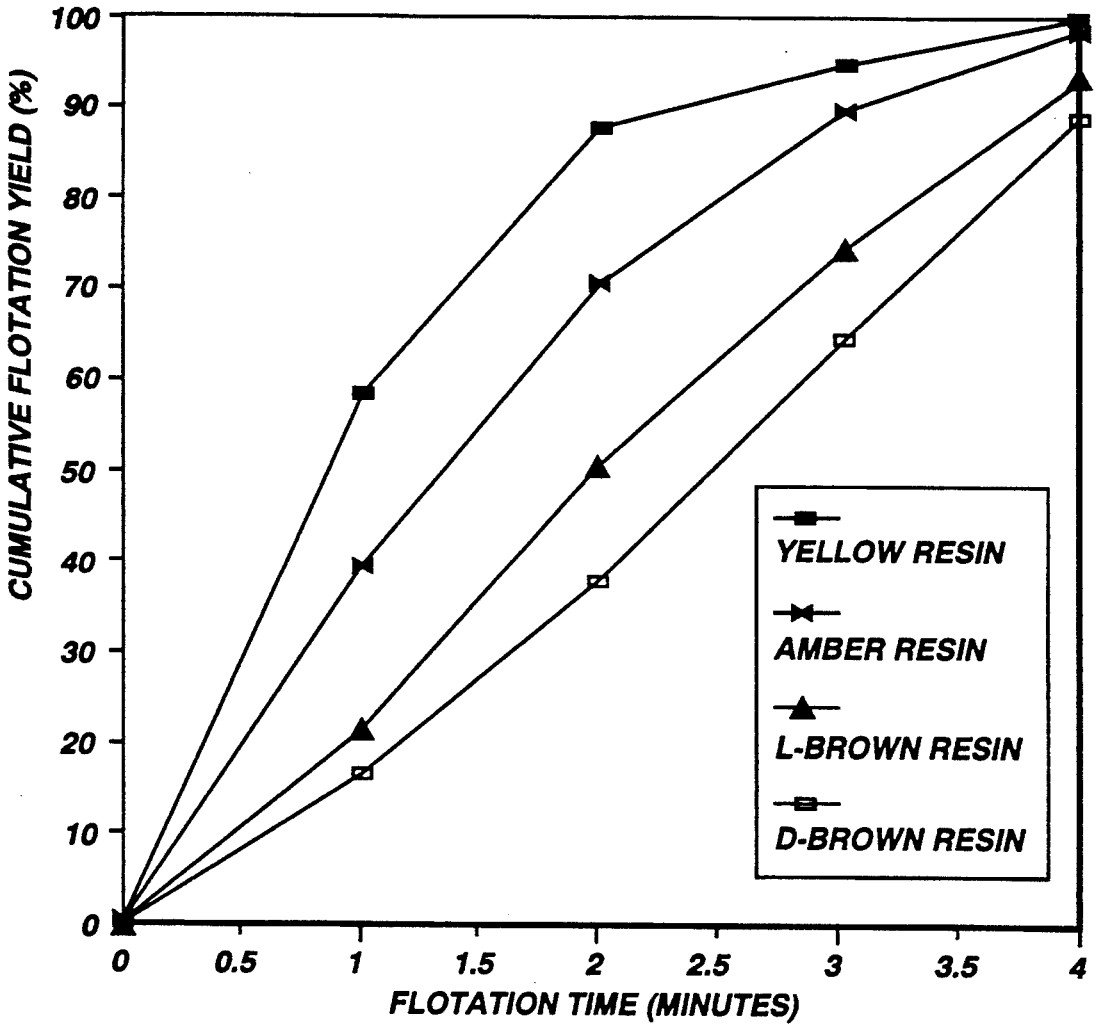
FIG. 8 is a graph illustrating recovery of different resin types as a function of time with a frother containing a blend of propanol, pentanol and butanol in a 6:3:1 ratio by volume.

As clearly shown in FIG. 8, the flotation with this blend of 5, 4 and 3 carbon alcohols can provide for the selective flotation separation of resin types. Yellow resin floats first, followed by amber resin, light-brown resin, and then dark-brown resin. For example, at a flotation time of two minutes, recoveries of these resins in the flotation concentrate are 88% for yellow resin, 70% for amber resin, 50% for light-brown resin, and only 37% for dark-brown resin. Note that the flotation order is the same as that expected from the results presented in FIG. 6.

EXAMPLE 5

Figure 9:
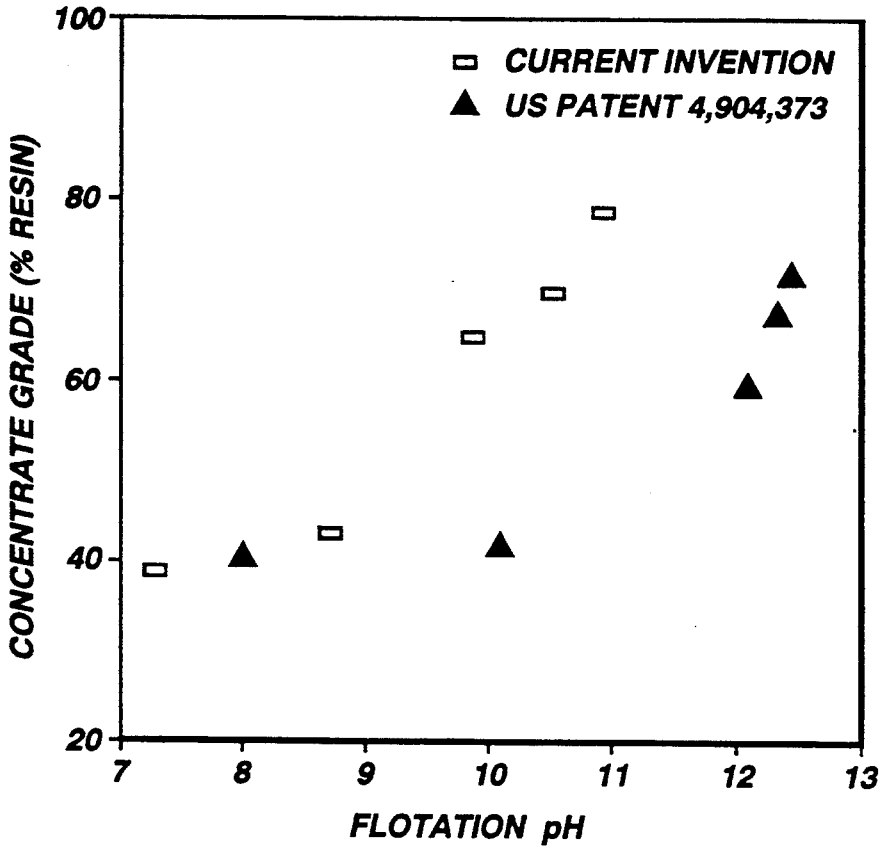
FIG. 9 is a graph comparing resin grade (resin content in the concentrate) as a function of flotation pH for the instant invention as compared with U.S. Pat. No. 4,904,373.

In this example, data were taken from continuous pilot-plant-scale flotation testing. The flotation circuit included both a rougher section and a cleaner section and was designed for 0.1 tph (dry solids) processing rate. In this test, the coal sample used was from Utah Power and Light Co., and was found to have a low resin content (about 5–6%) and a high mineral matter content (about 20% ash). The frothing reagents used were a blend of propanol (3 carbons) and butanol (4 carbons) at a ratio of 1:1 by weight. The test was done at a fixed reagent addition of about 0.6 kg/ton. During the test, the slurry pH was adjusted to different values for the purposes of comparison and demonstration. Under these conditions, it was observed that the flotation recovery of fossil resin was consistently maintained at approximately 70–80%. The concentrate grade (% resin), however, significantly varied with system pH as is evident from the data in FIG. 9. Included in FIG. 9 also are data from U.S. Pat. No. 4,904,373 for the purpose of comparison. As can be seen from FIG. 9, when this mixture of 3 carbon and 4 carbon frothing reagents is used for UP&L coal, the optimal floatation pH for the production of a concentrate containing about 80% fossil resin is at approximately pH 9–10, substantially lower than that recommended by U.S. Pat. No. 4,904,373. In this way, the current invention clearly demonstrate that the optimal pH for the flotation of fossil resin from coal actually is a function of coal type, which includes surface chemistry characteristics of the coal sample.

While a range of pH from about eight to about twelve and a variety of mixtures of alcohols containing five carbons or less, especially amyl, butyl and propyl alcohols are used to optimize recovery of resin from various coal types, (balance of resin grade and efficient recovery) the best combination for a particular coal type is readily determined as set forth herein.

EXAMPLE 6

Figure 10:
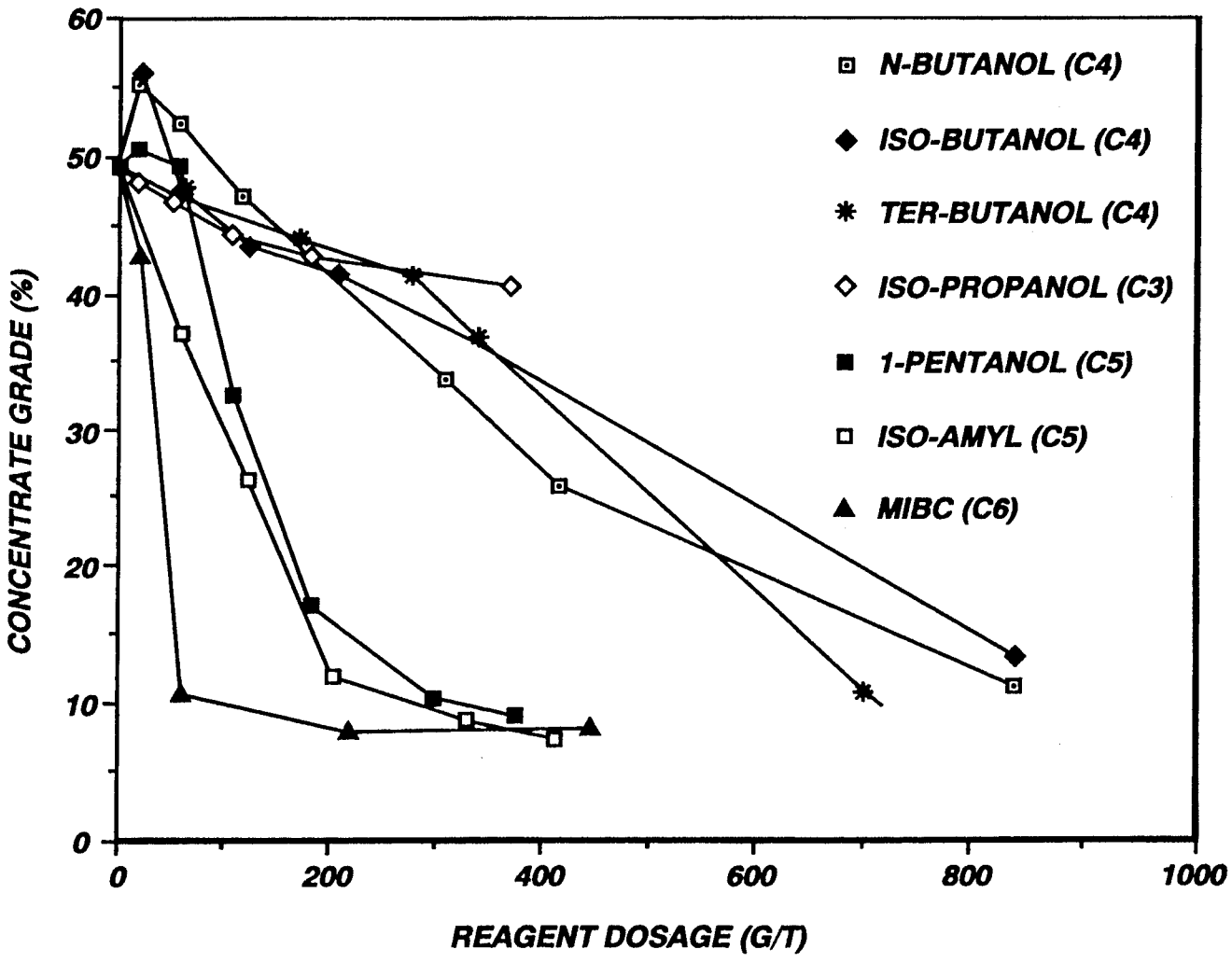
FIG. 10 is a graph illustrating resin content in the concentrate product as a function of reagent dosage for different frothing reagent (very low resin content in feed).

This example clearly demonstrates that the optimal number of carbon atoms in the frothing reagents for fossil resin flotation from coal is also a function of coal surface chemistry characteristics, or commonly, coal type. The same coal sample used in Example 5 has been used in a series of laboratory bench flotation tests. The testing was conducted with a 2 liter Denver flotation cell at 15% solids concentration, 900 rpm and air flowrate of 3.5 liter per minute. The flotation time was 5 minutes. Particle size was minus 100 mesh. These conditions basically were the same as those used for FIG. 2, except that the coal sample was different. The flotation pH was controlled at about pH 8 for all the tests. Only single stage flotation was conducted. Reagents used for these tests were isopropanol (3 carbon), n-butanol (4 carbon), isobutanol (4 carbon), ter-butanol (4 carbon), pentanol (5 carbon), isoamyl (5 carbon), methy isobutyl carbinol (6 carbon). The experimental results are given in FIG. 10. As clearly shown in FIG. 10, for this low grade resin (5–6% resin) and high ash (20% ash) coal sample, the best frothing reagent for flotation of fossil resin from coal should contain less than 5 carbon atoms. The results of n-butanol are particularly good. Both 5-carbon frothers used (pentanol and isoamyl) resulted in a flotation concentrate product containing a much lower fossil resin content. In this view, the relationship between carbon number of the frother and the coal type, or coal surface chemistry characteristics, is obvious.

Figure 11:
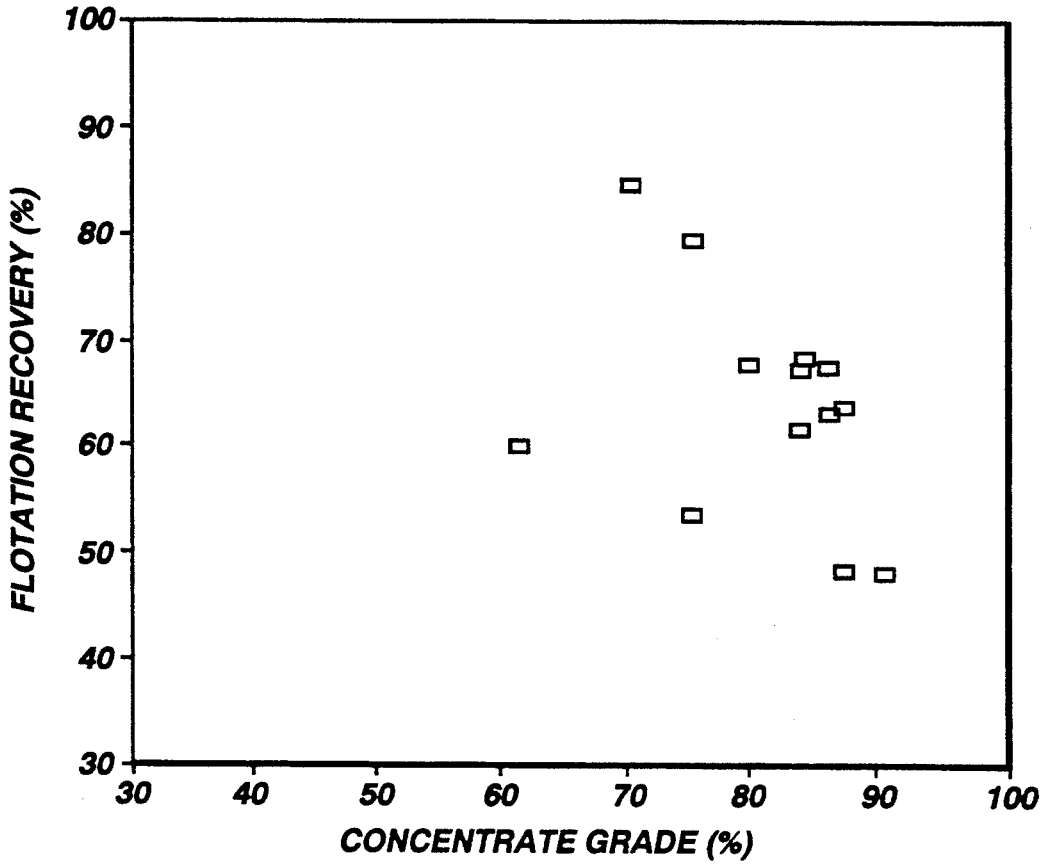
FIG. 11 is a graph illustrating the flotation recovery versus concentrate grade of resin from column flotation wherein the frothing agent is a 1:1 ratio of pentanol to butanol.

FIG. 11 gives further example as taught by the spirit of the current invention. In this work, a sample as used for example 2 was subject to the column flotation. The flotation was conducted with a 2-inch diameter column flotation cell, at about 15% solids concentration, pH 8.5–11, feed rate of approximately 1 liter per minute, 0.3–1 kg/ton of reagent dosage (1:1 ratio of pentanol to butanol), 50–250 ml of alkaline wash water flowrate at a pH of 8–11. As clearly shown from the figure, a satisfactory flotation separation can be achieved from column flotation cell following the spirit taught by the current invention.

To summarize, example 5 and 6 clearly show that an alkaline pH (pH 8 to 10) and short chain frother provide excellent selective fossil resin flotation from coal. The exact pH and the appropriate blend of short chain frothing reagents may vary somewhat depending on the resinous coal sample being processed.

In the above examples the utilization of butanol as a frother provides excellent results without addition of other frothers, however, butanol works well with amyl, propanol and other lower aliphatic polar compounds including propanoic acid, propyl amine and the like. Propanol by itself also works well with many coal types.

Lower aliphatic diols such as glycols, glycerols and the like are also useful frothers in the instant invention. Glycols such as propylene glycol, butylene glycol and the like are especially useful, either simply or in combination with other aliphatic polar compounds. Dramines and dicarboxylic acids may also be used successfully.

What is claimed is:

1. An improved froth flotation process for separating fine particles of fossil resin from fine coal particles by subjecting an aqueous slurry of said fine resin and coal particles to froth flotation in the presence of a frothing reagent wherein said frothing reagent consists essentially of an aliphatic hydrocarbyl alcohol or an aliphatic organic amine compound and with both the alcohol and the amine containing not more than 4 carbon atoms.

2. The improved flotation process of claim 1, wherein said alcohol is butanol.

3. The improved flotation process of claim 1 wherein said process is conducted within a column flotation cell.

4. The improved flotation process of claim 3 wherein said column process includes the addition of wash water to the froth formed and where the wash water pH is controlled at a higher pH than the aqueous slurry pH.

5. The improved flotation process of claim 4 wherein the pH of the aqueous slurry is maintained below about 10.5.

6. The process of claim 3 wherein wash water pH is maintained higher than that of the aqueous slurry.

7. The improved flotation process of claim 1 wherein the pH of the aqueous slurry is maintained at a level of about 8 to about 12.

8. The process of claim 1 wherein said hydrocarbyl alcohol or amine contains a single polar group.

9. An improved froth flotation process for separating fine particles of fossil resin from fine coal particles subjecting an aqueous slurry of said fine resin and coal particles to froth flotation in the presence of a frothing reagent wherein said frothing reagent consists essentially of a mixture of an aliphatic hydrocarbyl alcohol containing not more than 5 carbon atoms and a sufficient amount of a hydrocarbyl alcohol containing less than 5 carbon atoms to result in an increased separation of the fossil resin in the froth.

10. The improved flotation process of claim 9 wherein said frothing reagent consists essentially of at least a mixture of two alcohols selected from the class consisting of propyl, butyl and amyl alcohols.

11. The improved flotation process of claim 9 wherein said frothing reagent consists essentially of a mixture of propyl and/or butyl alcohol with amyl alcohol.

* * * * *